United States Patent [19]

Jeff

[11] Patent Number: 4,720,023

[45] Date of Patent: Jan. 19, 1988

[54] COMBINATION INSULATED MUG AND BEVERAGE CAN HOLDER

[76] Inventor: Michael J. Jeff, 3821 SE. 13th Ter., Gainesville, Fla. 32601

[21] Appl. No.: 428,354

[22] Filed: Sep. 29, 1982

[51] Int. Cl.[4] ..... B65D 25/18; B65D 81/38

[52] U.S. Cl. ..... 220/412; 215/12.1; 220/69; 220/85 H; 220/411; 220/413; 220/903

[58] Field of Search ..... 220/85 H, 408, 410, 220/411, 412, 90.2, 90.6, 413, 903, 69; 215/12 R, 100.5, 13 R

[56] References Cited

U.S. PATENT DOCUMENTS

| | | | |
|---|---|---|---|
| 166,350 | 8/1875 | Dodge | 220/85 H |
| 350,477 | 10/1886 | Case | 220/90.6 X |
| 3,013,691 | 12/1961 | Prentice | 220/408 X |
| 3,257,025 | 6/1966 | Jolly | 220/85 H |
| 3,285,455 | 11/1966 | Pewitt | 215/100.5 |
| 3,350,131 | 10/1967 | Tanzer | 215/100.5 X |
| 3,612,340 | 10/1971 | Heffran | 220/90.6 X |
| 4,163,374 | 8/1979 | Moore et al. | 220/85 H |
| 4,372,453 | 2/1983 | Branscum | 220/412 X |

FOREIGN PATENT DOCUMENTS

| | | | |
|---|---|---|---|
| 9676 | of 1903 | United Kingdom | 215/100.5 |

*Primary Examiner*—Allan N. Shoap

[57] ABSTRACT

Combination insulated mug and beverage can holder comprises a one-piece flexible ring-shaped retainer with an annular groove that mounts on the upper rim of an insulated mug. The annular groove on the retainer has an outside lip that has a slightly inward bias and is of a slightly smaller diameter than the outside of the flared or beaded portion of the mug that it fastens to. The inner edge of the flexible retainer has a lip (or tabs) that face inward and slightly down and is of a smaller diameter than the beverage can it is designed to hold and engage when the beverage can is inserted into the mug with a fitted retainer. When the retainer is fitted to the mug's upper rim the insulated mug functions as an insulated holder of a beverage can and when the retainer is not fitted to the upper rim the mug can function as a normal drinking vessel. By making the base of the mug recessed and similar in size and shape to the top of the mug the flexible retainer can be conveniently stored out of the way when the mug is being used as a drinking vessel.

4 Claims, 2 Drawing Figures

COMBINATION INSULATED MUG AND BEVERAGE CAN HOLDER

BACKGROUND OF THE INVENTION

1. Field of the Invention

The present invention relates to an insulated mug with a detachable flexible retainer that can function as both an insulated holder of a beverage can and as a normal drinking vessel 2. Description of the Prior Art Several insulated holders of beverage cans have been designed solely to serve as an insulated holder for a beverage can. Since these insulated holders are generally made of styrofoam or like materials their functional service life is greatly affected by the wear and tear they encounter.

Different beverage can holders with handles have been designed to give comfort and convenience to the user but they offer little or no insulation qualities in maintaining the temperature of the contents of the beverage can in relation to temperature variances.

SUMMARY OF THE INVENTION

The present invention comprises an improved insulated beverage can holder that can also function as a mug or drinking vessel, wherein the insulated mug with the flexible retainer mounted on the top rim can function as an insulated beverage can holder and when the retainer is removed from the top rim the mug can function as a normal drinking vessel.

The mug itself can be constructed of a rigid thermo-insulative material or else of a rigid double wall construction to give it insulation properties. The preferred material for constructing the mug is a plastic with thermo-insulative properties or else of a plastic double wall construction which has insulation properties due to its design, any other material could be used as long as it is suitable for a drinking vessel. The inside of the mug should be of sufficient diameter to allow the penetration of a beverage can to rest on the bottom of the mug without binding on the sides. The depth of the mug should be that after the beverage can rests on the bottom of the mug there is sufficient clearance of the beverage can above the rim retainer on the mug to allow the user easy access to the contents of the beverage can. The top rim of the mug should be flared outwardly or else beaded on the outside of the rim in order to provide a gripping surface for the removable retainer.

The one piece retainer can be constructed of a flexible plastic, rubber, or like material. The ring shaped retainer has an annular groove near the outside edge. The outside lip of the groove has a slight inward bias and should be of somewhat smaller diameter than the outside diameter of the flared or beaded rim of the mug that it fastens to. When fastening the retainer to the mug the outside lip of the annular groove portion of the retainer slips over the flared or beaded rim and snaps snugly in place. The retainer is held in place by the resilient lip of the annular groove being of slightly smaller diameter than the flared or beaded portion of the mug on which it is fastened.

The inside flexible edge or lip of the retainer faces inwardly and is of a slightly smaller diameter than the beverage can it is designed to hold. When the retainer is fastened to the top rim the inside lip (or tabs) provide a resilient gripping surface for the beverage can that is inserted into the mug. The flexible retainer is designed to be easy to snap on or off the rim of the mug but at the same time exert a strong enough hold on the mug so as not to be detached when inserting or withdrawing a beverage can. The inner edge or lip of the retainer is designed to snugly hold and engage a beverage can but at the same time allow easy insertion and withdrawal of the beverage can. By providing grooves or slots on the inside edge of the retainer venting of atmospheric gases is possible and easier insertion and withdrawal of the beverage can is permitted.

By making the base of the insulated mug recessed and similar in size and shape to the top rim on the insulated mug the retainer can be conveniently stored out of the way when needed. The base only needs to be recessed enough to allow an unencumbered snug fit of the retainer.

The present invention thus provides a dual purpose insulated mug which can function as an insulated beverage can holder as well as a functional insulated drinking vessel.

These and other advantages and features of the present invention will hereinafter appear, and, for purposes of illustration, but not of limitation, a preferred embodiment of the present invention is described in detail below and shown in the appended drawings.

DETAILED DESCRIPTION OF PREFERRED EMBODIMENT

Figure 1:
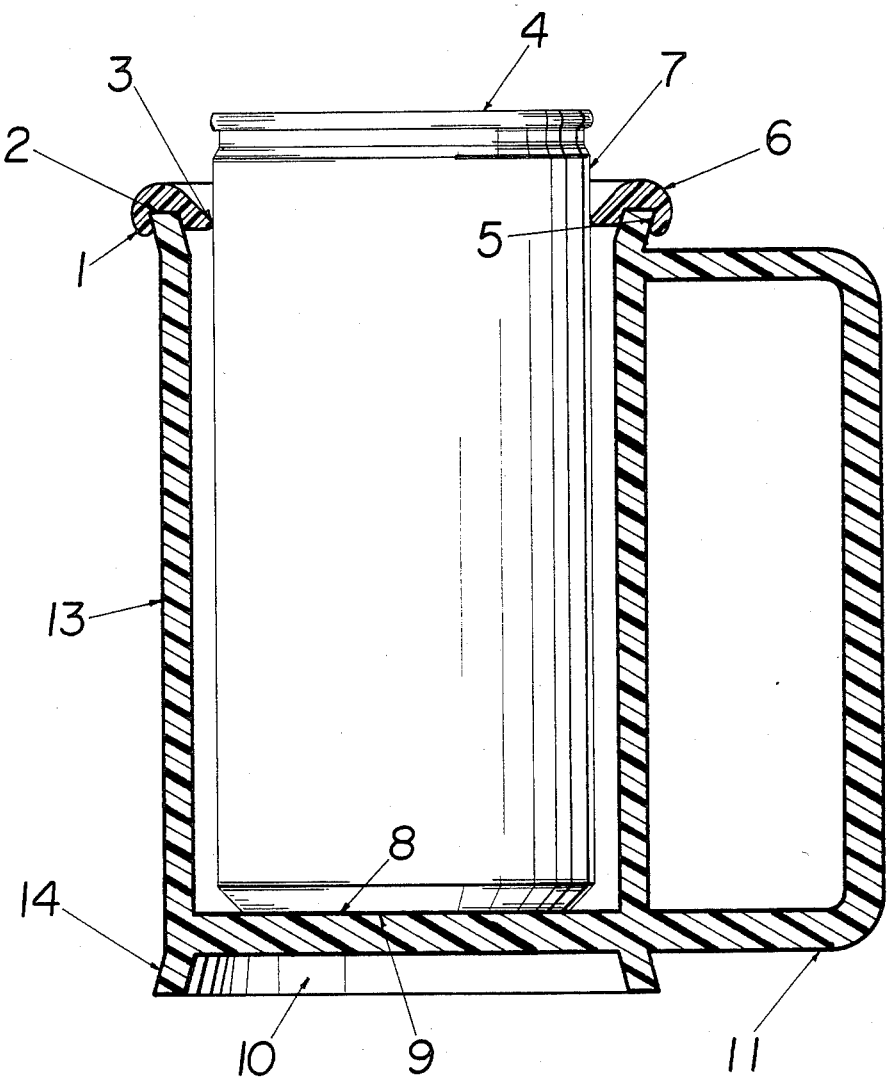
FIG. 1 is a partial sectional view of the present invention showing the combination insulated mug and beverage can holder engaging a beverage can that has been fully inserted into the insulated mug fitted with a removable retainer to the top rim as well as showing the recessed base of the insulated mug

Referring now to the drawings, combination insulated mug and beverage can holder in accordance with the present invention is shown for illustration purposes in FIG. 1 with the removable beverage can retainer 6 mounted on the flared rim 5 of the insulated mug 13 and with the inner edge or lip of the retainer 3 engaging and holding a beverage can 4 that has been fully inserted into the mug 13 and with the base of the beverage can 8 resting on the bottom of the mug 9.

The one piece ring-shaped beverage can retainer 6 can be constructed of a flexible plastic, rubber, or like material. The retainer 6 is designed to mount on the flared rim 5 of the insulated mug 13. The beverage can retainer 6 has an annular groove 2 near its outside edge and the groove is designed to fit the flared rim of the mug 5. The outside lip 1 of the groove 2 having a slight inward bias and slightly smaller diameter than that portion of the flared rim 5 that it fastens to. When fastening the retainer 6 to the mug 13 the outside lip 1 of the annular groove 2 portion of the retainer 6 slips over the flared or beaded rim 5 and snaps snugly in place. It can be seen from FIG. 1 that retainer 6 has a rounded lower inside edge. It is apparent that such edge functions to ease the assembly of the retainer on the flared rim. The beverage can retainer 6 is held in place by the resilient lip 1 of the annular groove 2 being of slightly smaller diameter than the flared or beaded outside portion 5 of the mug 13 on which it attaches to. Projections or grooves both inside and outside of the rim area could be used as a fastening point for the retainer 6 but since a flared rim 5 or rim with an outside bead offer the least emcumberance to drinking for the user the preferred embodiment would be to use either of those two methods since the mounting would be similar in both cases. In the case of the beaded rim as long as the outside lip of the retainer is of a slightly smaller diameter than the beaded rim it will fasten to the rim. The inside edge or lip 3 of the retainer 6 faces inwardly and is designed to engage and hold a beverage can 4 that is inserted into the mug 13 that is fitted with a retainer 6. The inside diameter 3 of the fitted retainer 6 should be slightly smaller than the beverage can it is designed to hold and engage. The inside edge of the retainer 3 should taper to a flexible lip or tab that is flexible enough to allow the easy insertion and withdrawal of the beverage can 4 but at the same time exert a snug grip on the side of the beverage can 7. While the retainer 6 should be easy to snap on or off it is designed to stay fastened whenever a beverage can 4 is inserted or withdrawn from a mug 13 with a mounted retainer.

The insulated mug can be constructed out of many insulative materials that are suitable for a insulated mug 13 but the preferred material is a plastic with thermo-insulative properties or else of a plastic double wall construction which has insulation properties due to its design. The inside diameter of the insulated mug 13 should be large enough to allow the full insertion of a beverage can 4 without the can binding on the inside of the mug 13 before the base of the can 8 rests on on the bottom of the mug 9. The depth of the mug 13 should be limited so that when the can 4 is resting on the bottom of the mug 9 there is sufficient clearance above the rim mounted retainer 6 on the mug to allow the user easy access to the contents of the beverage can 4. Although it is not necessary to the function of an insulated beverage can holder the mug handle 11 is designed to give comfort and convenience to the user.

By making the insulated mug 13 with a recesed base 10 similar in size and shape to the flared rim 5 the retainer 6 can be conveniently stored out of the way when the user wants the insulated mug 13 to function as a drinking vessel. The rim of the base 14 should be flared out like the flared upper rim 5 so that the retainer 6 can snap to the base 10 when not in use. The recessed base of the mug 10 need only be recessed enough to allow an unemcumbered snug fit of the retainer 6.

With the beverage can retainer 6 fastened to the insulated mug 13 and beverage can inserted 4 the insulated mug 13 functions as an insulated beverage can holder and can help maintain the serving temperature of the contents of the beverage can 4 for the user.

Figure 2:
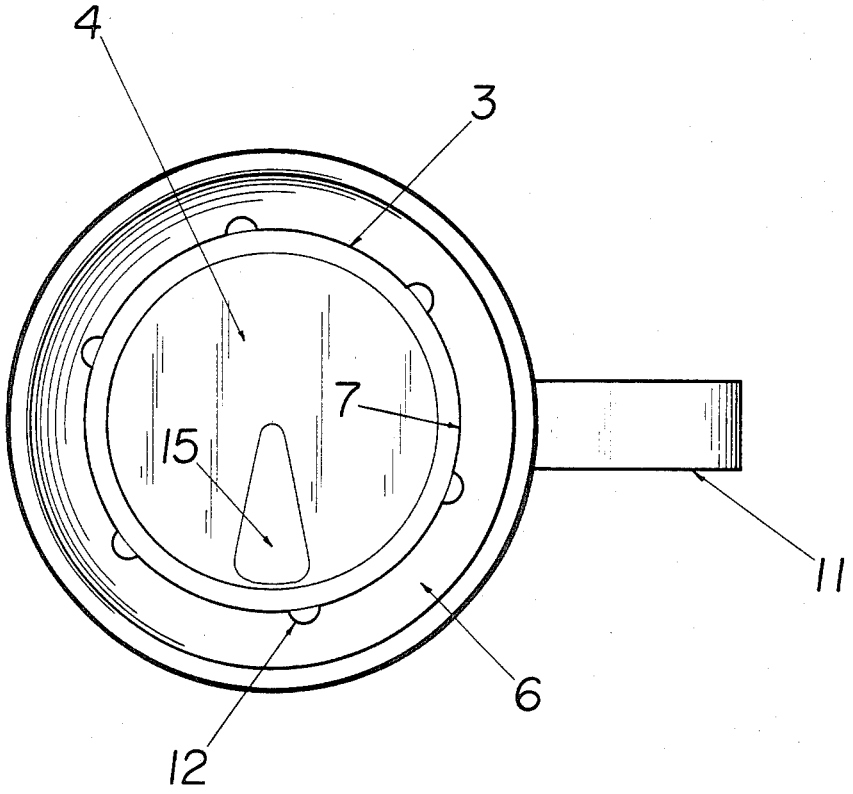
FIG. 2 is a top view showing the mounted retainer holding and engaging a beverage can that has been fully inserted into the mug as well as showing the venting grooves or slots on the inner edge of the retainer.

Referring now to FIG. 2 with the removable retainer 6 mounted and engaging the side of the beverage can 7 with its flexible inner lip or edge 3 that extends around the circumference of the beverage can 4. The vent grooves or slots 12 located on the edge or lip 3 of the retainer 6 allow venting of atmospheric gases when inserting or withdrawing the beverage can 4 from the snug fitting retainer 6. By providing vent grooves or slots 12 venting is possible and easier insertion and withdrawal of the beverage can 4 is permitted. The mug handle 11 is a convenient aid for the user in handlining the insulated beverage can holder and when the user desires he can remove the contents of the beverage can 4 in the usual fashion from the can top opening 15

It should be understood that the embodiment desired herein are merely exemplary of the preferred practice of the present invention and that various changes and modifications may be made in the arrangements and details of construction of the embodiments described herein with out departing from the spirit and scope of the present invention.

The embodiment of the invention in which an exclusive property or privoledge is claimed are defined as follows:

1. A combination of an insulated mug and a beverage container retainer ring comprising a generally cylindrical tubular mug body having a support base end and an opposite open top portion at respective ends of the mug body defined by outwardly flared rims at each end of the tubular body, an internally transversely extending wall adjacent one end of the tubular body that completely closes off the base end of the tubular body, the inside diameter of the body being sufficiently large to permit the insertion of a generally cylindrical beverage container therein, said mug body formed from a rigid insulated material, an annular beverage container retainer ring made of a flexible rubber-like material, said retainer ring having an inner tapered flexible generally radially inwardly extending circular lip, said ring also having an annular axially extending groove near its outer edge that defines an axially extending outer lip, said ring defining groove extends in a direction that is generally perpendicular to the radially inwardly extending lip, said annular ring groove further having a cross-sectional configuration that is generally similar in size and shape to the cross section of the flared rims of the mug at each end, said flared mug rims being angled outwardly from the axis of the tubular body so that the portion of the rim adjacent the tubular body is of a smaller diameter than the end portions of both mug rims, the largest diameter of the annular groove of the ring being slightly smaller than the large diameter of the mug rims that the retainer ring is fastened to, said outer lip of the ring having a rounded lower inside edge that functions to ease the assembly of the ring on the mug rims so that when the flexible ring is pressed on the mug rim at either end of the tubular body the outer lip of the ring is capable of being slipped over the flared rim adjacent thereto and resisting removal therefrom, the insulated mug being usable as a drinking vessel with the retainer ring being secured to the base rim for storing the retainer ring and for convenient access thereof, and said insulated mug being usable as a beverage container insulator and beverage container holder and retainer with the retainer ring being secured to the rim at the top portion of the mug and aiding in retaining a beverage container insertable into the mug by surrounding and engaging a wall portion of the beverage container.

2. The container of an insulated mug and beverage container retainer ring according to claim 1 wherein the beverage container retainer ring lip has a surface that tapers downwardly and inward from the top of the ring and has a surface along a horizontal line to the bottom edge of the ring that rests on the inside of the tapered rim, said inner flexible lip defining a slightly smaller inside diameter than the outside diameter of the beverage container that it is designed to resiliently hold and engage, so that when a beverage container is inserted in the mug a leading edge of the flexible lip will flex downwardly slightly and exert pressure on the sides of the container and securely hold it in place, said inner flexible lip also having at least one vent groove along the inner edge to allow the venting of air when inserting or withdrawing the beverage container, the retainer ring is designed to remain on the rim of the mug when the beverage container is inserted or withdrawn, but the ring can be easily removed by pressing up along its outer lip when the insulated mug is to be used as a drinking vessel.

3. The combination of an insulated mug and beverage container retainer ring according to claim 2 wherein the beverage container that is insertable into the insulated mug is limited in the extent of its longitudinal insertability therein by the transverse wall of the tubular body, a fully inserted beverage container rests on the transverse wall and provides sufficient clearance at the top portion of the mug to enable the user easy access to the contents of the beverage can, the inside diameter of the tubular mug being slightly larger than the beverage container and allows the full penetration of the beverage contaienr without binding on the inside of the mug, the fully inserted beverage container and the insulated mug have entrapped air between the container and the mug adding to the insulative qualities thereof.

4. The combination of an insulated mug and beverage container retainer ring in any one of claims 1–3 wherein the insulated mug further includes a handle secured to the tubular body for the convenience of the user.

* * * * *

UNITED STATES PATENT AND TRADEMARK OFFICE

CERTIFICATE OF CORRECTION

PATENT NO. : 4,720,023

DATED : January 19, 1988

INVENTOR(S) : Michael J. Jeff

It is certified that error appears in the above-identified patent and that said Letters Patent is hereby corrected as shown below:

Column 3, line 5, "emcumberance" should read -- encumbrance --

Column 3, line 41, "recesed" should read -- recessed --,

Column 3, line 49, "unemcumbered" should read -- unencumbered --

Column 3, line 65, "handlining" should read -- handling --

Column 4, line 1, "embodiment" should read -- embodiments --

Column 4, line 6, "with out" should read -- without --

Column 4, line 8, "embodiment" should read -- embodiments --

Column 4, line 9, "privoledge" should read -- privilege --

Claim 2, column 4, line 55, "container" should read -- combination --

Claim 3, column 6, lines 4 and 5, "contaienr" should read --container --.

Signed and Sealed this

Seventeenth Day of May, 1988

*Attest:*

*Attesting Officer*

DONALD J. QUIGG

*Commissioner of Patents and Trademarks*